US009759445B2

(12) United States Patent
Kim et al.

(10) Patent No.: US 9,759,445 B2
(45) **Date of Patent: *Sep. 12, 2017**

(54) AIR CONDITIONER

(71) Applicant: LG ELECTRONICS INC., Seoul (KR)

(72) Inventors: Hyunjung Kim, Changwon-si (KR); Jongsun Jeon, Changwon-si (KR); Jaeseung Choi, Changwon-si (KR); Moonsung Kim, Changwon-si (KR); Hayoung Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 859 days.

This patent is subject to a terminal disclaimer.

(21) Appl. No.: 13/921,491

(22) Filed: Jun. 19, 2013

(65) Prior Publication Data

US 2014/0099875 A1 Apr. 10, 2014

(30) Foreign Application Priority Data

Oct. 10, 2012 (KR) ..... 10-2012-0112223
Oct. 12, 2012 (KR) ..... 10-2012-0113437

(51) Int. Cl.
*F24F 13/10* (2006.01)

(52) U.S. Cl.
CPC ..... *F24F 13/10* (2013.01)

(58) Field of Classification Search
CPC ..... F24F 13/10; F24F 13/075; F24F 13/12; F24F 13/1413; F24F 13/1486; F24F 13/20; F24F 1/0014; F24F 2001/0048; F24F 2013/1473; F24F 2221/26; F24F 2221/54
USPC ..... 454/284, 322, 323
See application file for complete search history.

(56) References Cited

U.S. PATENT DOCUMENTS 3,420,592 A 1/1969 Ogata et al.
5,299,978 A * 4/1994 Dennis ..... F24F 13/14 454/285
5,461,875 A * 10/1995 Lee ..... F24F 11/00 454/236

(Continued)

FOREIGN PATENT DOCUMENTS

CN 1264815 8/2000
CN 2833393 11/2006

(Continued)

OTHER PUBLICATIONS

U.S. Office Action issued in co-pending U.S. Appl. No. 13/954,160 dated Aug. 18, 2015.

(Continued)

*Primary Examiner* — Steven B McAllister
*Assistant Examiner* — Reginald McNeill, II
(74) *Attorney, Agent, or Firm* — KED & Associates, LLP

(57) ABSTRACT

An air conditioner is provided. The air conditioner may include a case, first and second discharge ports disposed on opposite sides of the case to discharge air, at least one discharge vane rotatably disposed at each of the first and second discharge ports, and an operation panel disposed between the first and second discharge ports. The operation panel is movable to selectively vary a discharge area of each of the first and second discharge ports. The discharge are selectively rotatable when not covered by the operation panel to vary an air flow direction.

14 Claims, 24 Drawing Sheets

(56) References Cited

U.S. PATENT DOCUMENTS

| | | | | |
|---|---|---|---|---|
| 5,807,170 | A * | 9/1998 | Lee | F24F 1/0007 454/233 |
| 6,131,336 | A | 10/2000 | Krause et al. | |
| 6,338,382 | B1 * | 1/2002 | Takahashi | F24F 1/0007 165/119 |
| 9,255,722 | B2 * | 2/2016 | Kim | F24F 1/0014 |
| 2001/0052240 | A1 | 12/2001 | Kim et al. | |
| 2002/0084058 | A1 * | 7/2002 | Ozeki | B60H 1/0005 165/42 |
| 2004/0126198 | A1 | 7/2004 | Chen | |
| 2006/0032260 | A1 | 2/2006 | Kang | |
| 2006/0037355 | A1 | 2/2006 | Hwang et al. | |
| 2009/0199583 | A1 | 8/2009 | Jeon et al. | |
| 2009/0241576 | A1 * | 10/2009 | Tsuji | F24F 1/0007 62/259.1 |
| 2010/0288062 | A1 | 11/2010 | Meyer | |
| 2010/0307717 | A1 | 12/2010 | Yamashita et al. | |
| 2014/0099875 | A1 | 4/2014 | Kim et al. | |

FOREIGN PATENT DOCUMENTS

| | | |
|---|---|---|
| CN | 101063538 | 10/2007 |
| CN | 101761944 | 6/2010 |
| CN | 103727587 | 10/2016 |
| EP | 2014997 A1 | 1/2009 |
| EP | 2290296 A1 | 3/2011 |
| JP | 2009-041898 | 2/2009 |

OTHER PUBLICATIONS

U.S. Appl. No. 13/954,160, filed Jul. 30, 2013.
European Search Report issued in Application No. 13164881.8 dated Aug. 6, 2013.
U.S. Office Action issued in U.S. Appl. No. 13/954,160 dated Apr. 28, 2015.

* cited by examiner

AIR CONDITIONER

CROSS-REFERENCE TO RELATED APPLICATION(S)

This application claims priority under 35 U.S.C. §119 to Korean Application Nos. 10-2012-0112223 filed on Oct. 10, 2012 and 10-2012-0113437 filed on Oct. 12, 2012, whose entire disclosures are hereby incorporated by reference.

BACKGROUND

1. Field

The present disclosure relates to an air conditioner.

2. Background

Air conditioners maintain indoor air in a cold state in summer and in a warm state in winter, control humidity of the indoor air, and purify indoor air. Air conditioners may have a refrigeration cycle including a compressor, a condenser, an expansion device, and an evaporator. Air conditioners may be classified into a split type air conditioner in which indoor and outdoor units are separated from each other and an integral type air conditioner in which indoor and outdoor units are integrally coupled to each other as a single device. Air conditioners are classified into a wall-mounted type air conditioner, a frame type air conditioner, and a stand alone type air conditioner according to an installation method.

Such an air conditioner may include a suction part for drawing in air from within an indoor space, a heat exchanger that performs heat-exchange with the air suctioned through the suction part, and a discharge part for discharging air heat-exchanged air into the indoor space. The air conditioner may also include a blower fan for generating an airflow from the suction part to the discharge part. Air may be discharged in a predetermined direction through the discharge part, and thus it may be difficult to adequately control the discharge direction, or an amount of air discharged through a particular one of the discharge parts.

BRIEF DESCRIPTION OF THE DRAWINGS

The embodiments will be described in detail with reference to the following drawings in which like reference numerals refer to like elements wherein.

DETAILED DESCRIPTION

In the following detailed description, reference is made to the accompanying drawings that form a part hereof, and in which is shown by way of illustration specific embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. The description may omit certain information known to those skilled in the art. The following detailed description is, therefore, not to be taken in a limiting sense, and the scope may be defined by the appended claims.

Figure 1:
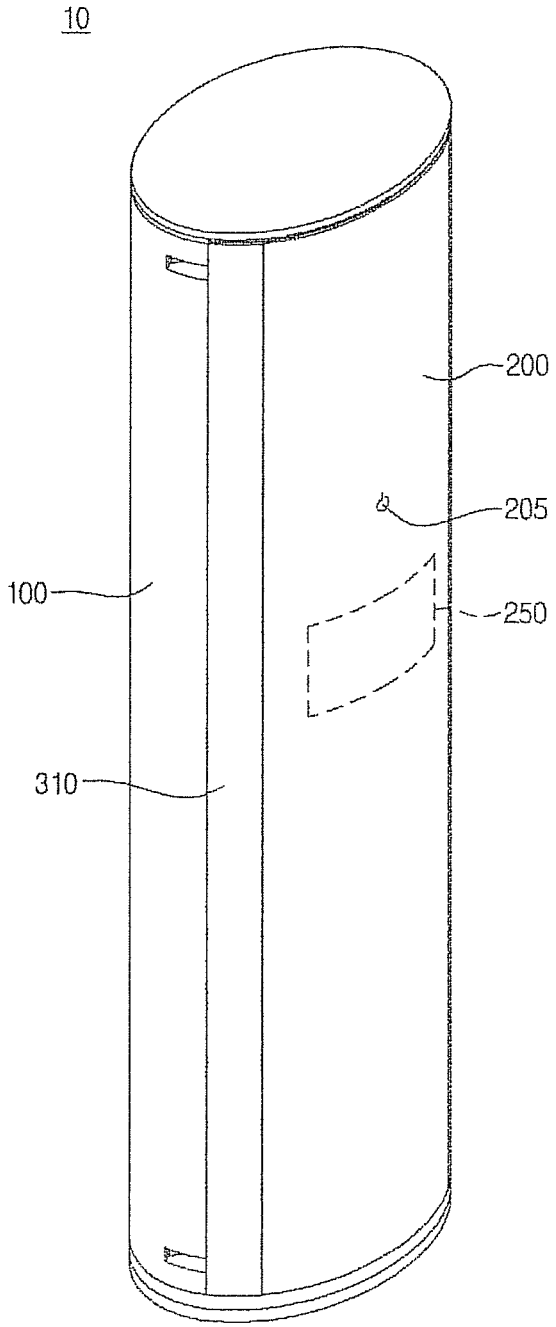
FIG. 1 is a perspective view of an air conditioner according to an embodiment as broadly described herein.
Figure 2:
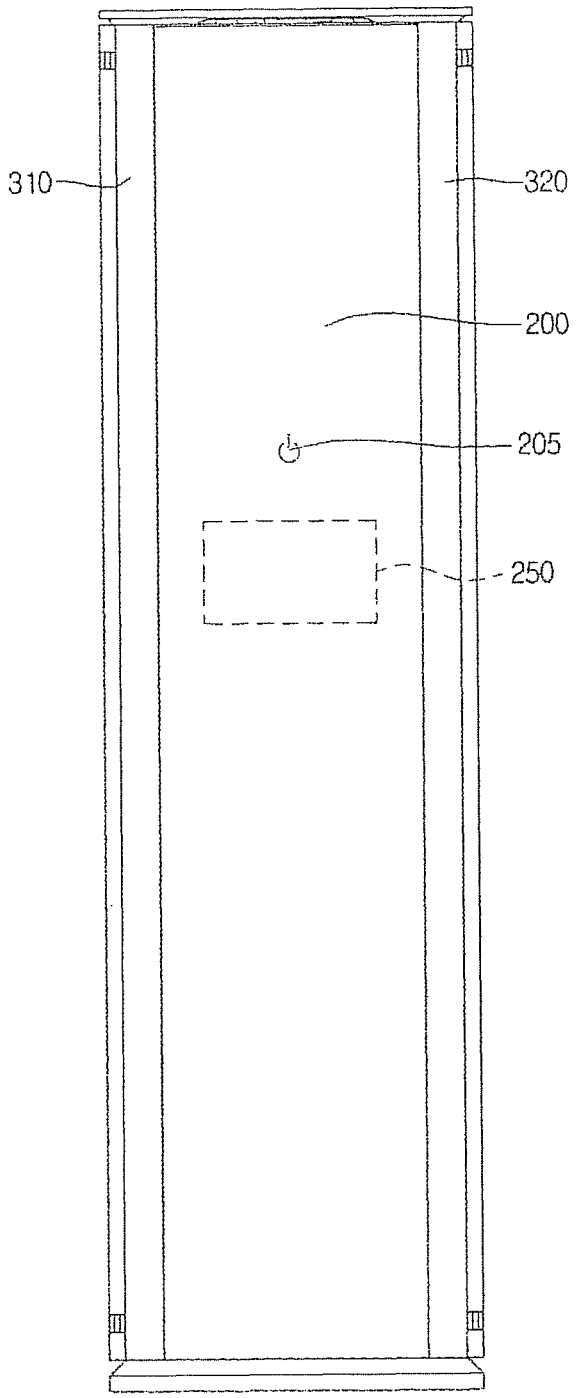
FIG. 2 is a front view of the air conditioner shown in FIG. 1.

Referring to FIGS. 1 and 2, an air conditioner 10 according to an embodiment as broadly described herein may include a case 100 defining an inner space, a movable operation panel 200 disposed on a side of the case 100, i.e., a front side of the case 100, and movable discharge panels 310 and 320 disposed on at least one side of the operation panel 200. In certain embodiments, the case 100 may have a somewhat rounded outer appearance. For example, the case 100 may have an approximately oval cross-sectional shape.

An outer appearance of a front or side surface of the air conditioner 10 may be defined by the operation panel 200 and/or the discharge panels 310 and 320. At least portions of the operation panel 200 and the discharge panels 310 and 320 may be rounded to correspond to that of the case 100.

An input device 205 which may receive a user input command may be provided on the operation panel 200. For example, the input device 205 may turn on/off a power of the air conditioner 10.

A display 250 for displaying information related to operation of the air conditioner 10 may also be provided on the operation panel 200. The display 250 may be hidden when the air conditioner 10 is turned off, and exposed when the input device 205 is manipulated to turn on the air conditioner 10.

The discharge panels 310 and 320 may include a first discharge panel 310 provided on a first side of the operation panel 200 and a second discharge panel 320 provided on a second side of the operation panel 200. The first discharge panel 310 and the second discharge panel 320 may be moved in directions toward or away from the operation panel 200.

Figure 3:
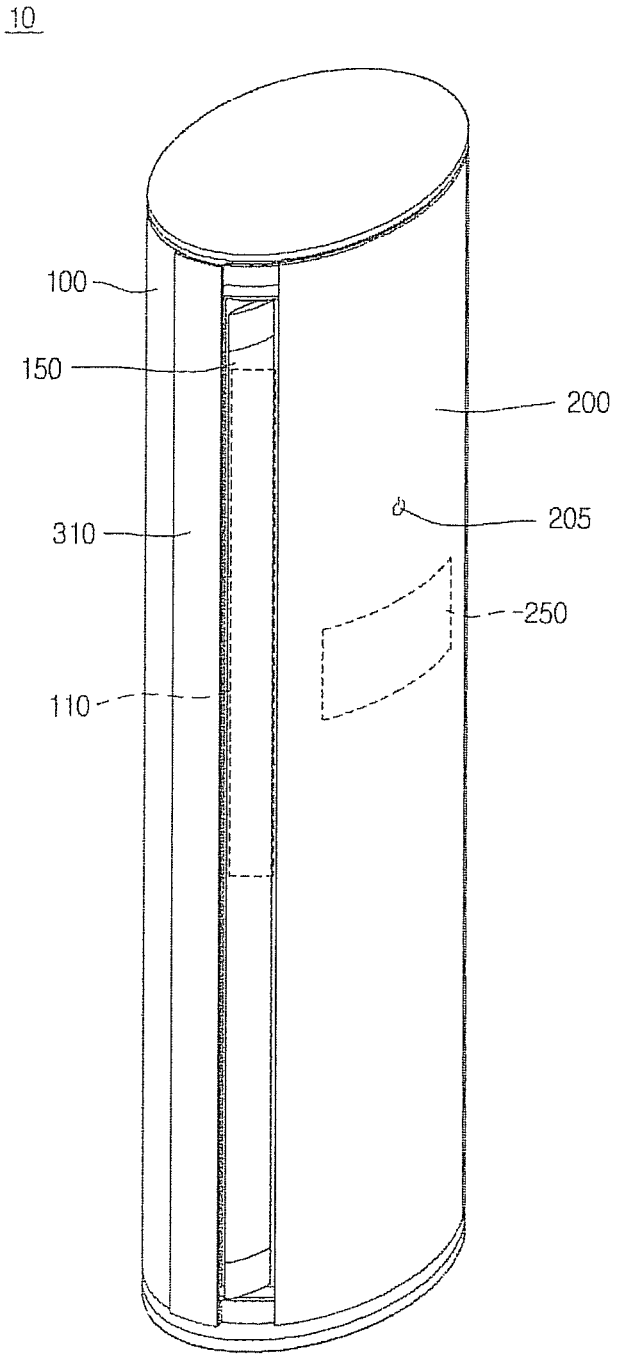
FIG. 3 is a perspective view of the air conditioner shown in FIG. 1, with a discharge panel thereof in an open position, according to an embodiment.
Figure 4:
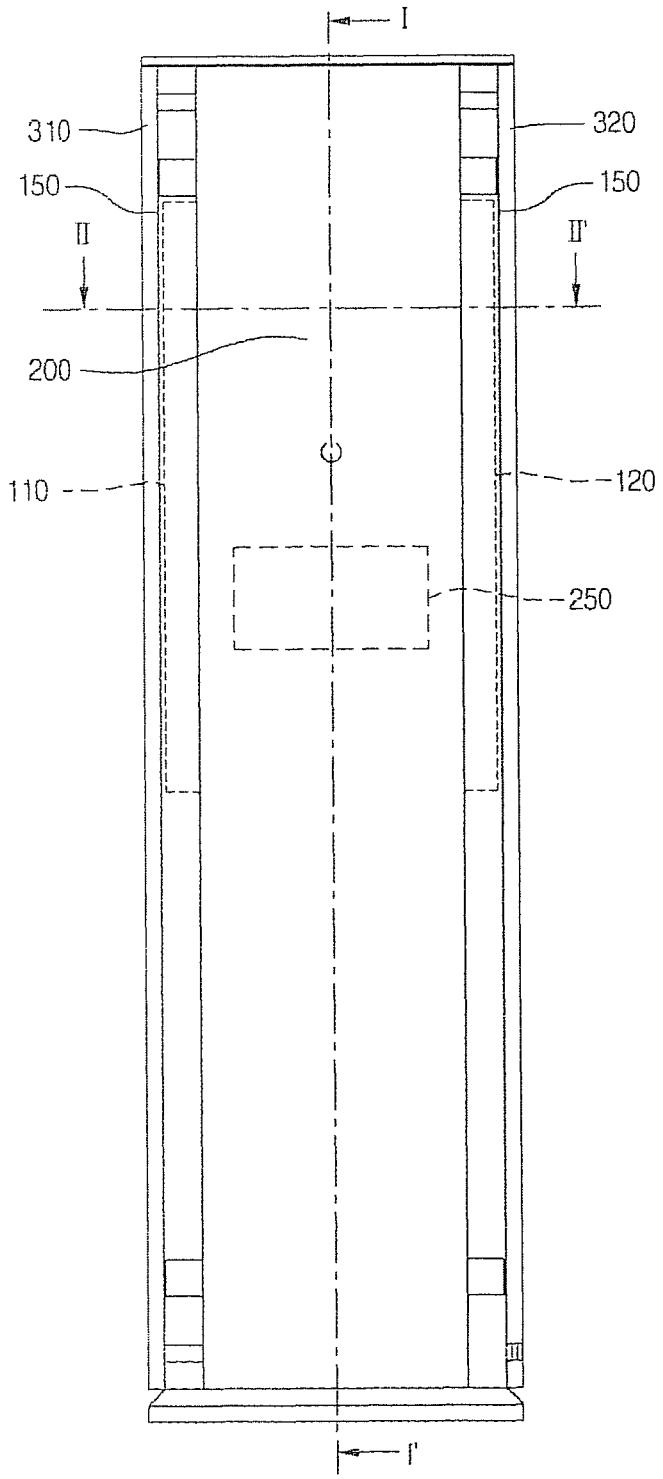
FIG. 4 is a front view of the air conditioner shown in FIG. 1, with the discharge panel thereof in an open position, according to an embodiment.

Referring to FIGS. 3 and 4, the air conditioner 10 according to an embodiment as broadly described herein may include discharge ports 110 and 120 through which air may be discharged. The discharge ports 110 and 120 may each be disposed on a side of the case 100, particularly, two opposite sides of a front surface of the case 100. A discharge grill for preventing introduction and/or discharge of foreign substances may be disposed in each of the discharge ports 110 and 120.

The discharge ports 110 and 120 may include a first discharge port 110 disposed at the first side of the operation panel 200 and a second discharge port 120 disposed at the second side of the operation panel 200. The first and second discharge ports 110 and 120 may be spaced apart from each other.

The operation panel 200 may cover at least a portion of the first discharge port 110 and at least a portion of the second discharge port 120. Alternatively, the operation panel 200 may fully cover one of the first or second discharge port 110 and 120 and fully open the other of the first or second discharge ports 110 and 120. In detail, the operation panel 200 may be disposed between the first discharge port 110 and the second discharge port 120 to partition the first discharge port 110 from the second discharge port 120.

The first discharge panel 310 may selectively open or close the first discharge port 110. In detail, the first discharge panel 310 may be moved in a direction (a left direction in the view shown in FIG. 4) away from the operation panel 200. In this process, at least a portion of the first discharge port 110 may be opened. On the other hand, the first discharge panel 310 may be moved in a direction (a right direction in the view shown in FIG. 4) toward the operation panel 200. In this process, the first discharge port 110 may be covered.

The second discharge panel 320 may selectively open the second discharge port 120. In detail, the second discharge panel 320 may be moved in a direction (a right direction in the view shown in FIG. 4) away from the operation panel 200. In this process, at least a portion of the second discharge port 120 may be opened. On the other hand, the second discharge panel 320 may be moved in a direction (a left direction in the view shown in FIG. 4) toward the operation panel 200. In this process, the second discharge port 120 may be covered.

When the first and second discharge ports 110 and 120 are respectively covered by the first and second discharge panels 310 and 320, the air conditioner 10 may be in the state shown in FIGS. 1 and 2.

One or more discharge vanes 150 may be rotatably installed at each of the first and second discharge ports 110 and 120. The discharge vanes 150 may be configured to adjust a discharge direction of air discharged from the first and second discharge ports 110 and 120. The discharge vanes 150 may be disposed at a rear side of the operation panel 200 or the discharge panels 310 and 320. In the current embodiment, a pair of discharge vanes 150 may be disposed at each of the discharge ports 110 and 120.

When the first or second discharge panel 310 or 320 is opened, the corresponding discharge vane 150 may be exposed to the outside. When the discharge vane 150 is exposed via the open panel, air may be discharged to the outside through the first or second discharge port 110 or 120.

Hereinafter, an operation of the air conditioner according to the current embodiment will be described.

In a state in which the air conditioner 10 is turned off, as shown in FIGS. 1 and 2, the operation panel 200 may be disposed at a front central portion of the case 100, with the first and second panels 310 and 320 covering the first and second discharge ports 110 and 120 on opposite sides of the operation panel 200, respectively.

Here, the position of the operation panel 200 may be referred to as a "central position" or a "first position". The operation panel 200 may cover at least a portion of the first discharge port 110 and at least a portion of the second discharge port 120 when it is at the central position. That is, a horizontal width of the operation panel 200 may be greater than a distance between the first discharge port 110 and the second discharge port 120.

When a user manipulates the input device 205 to turn on the air conditioner 10, each of the first and second discharge panels 310 and 320 may be moved in the direction away from the operation panel 200 and opened. For example, the first discharge panel 310 may be moved in a left direction, and the second discharge panel 320 may be moved in a right direction. When the first and second discharge panels 310 and 320 are opened, the corresponding discharge vanes 150 are exposed to the outside. Then, the discharge vanes 150 may be rotated to open the first discharge port 110 and/or the second discharge port 120. That is, air may be discharged at the two opposite sides of the operation panel 200. A flow direction of air discharged from the first and second discharge ports 110 and 120 may be adjusted according to a rotated angle of the discharge vane 150.

When the input device 205 is manipulated while the air conditioner 10 is operated, the air conditioner 10 may be turned off. When the power is turned off, the discharge vane 150 may be rotated to a position at which the first and second discharge ports 110 and 120 may be covered. Also, the first and second discharge panels 310 and 320 may be moved back toward the operation panel 200 to cover the first and second discharge ports 110 and 120. For example, the first discharge panel 310 may be moved in a right direction, and the second discharge panel 320 may be moved in a left direction. When the first and second discharge panels 310 and 320 are closed, as shown in FIG. 2, the first and second panels 310 and 320 may approximately contact the two opposite sides of the operation panel 200.

Figure 5:
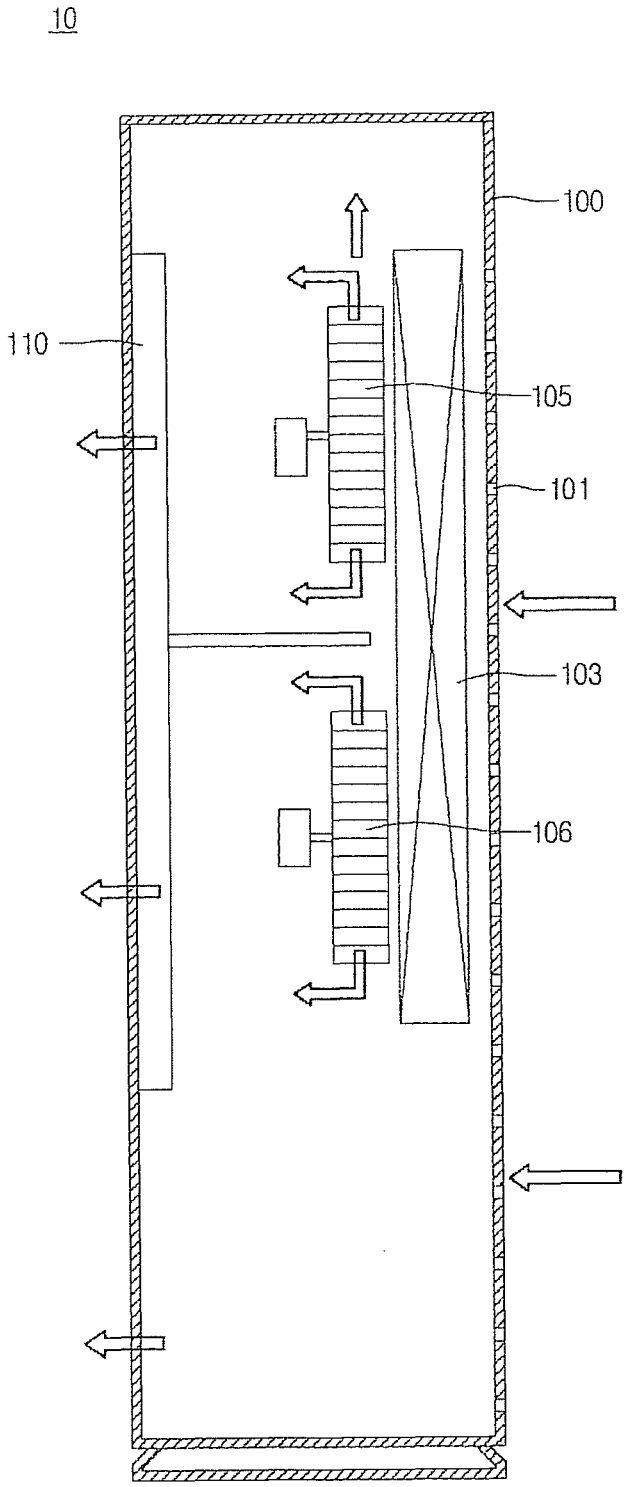
FIG. 5 is a cross-sectional view taken along line I-I' of FIG. 4.
Figure 6:
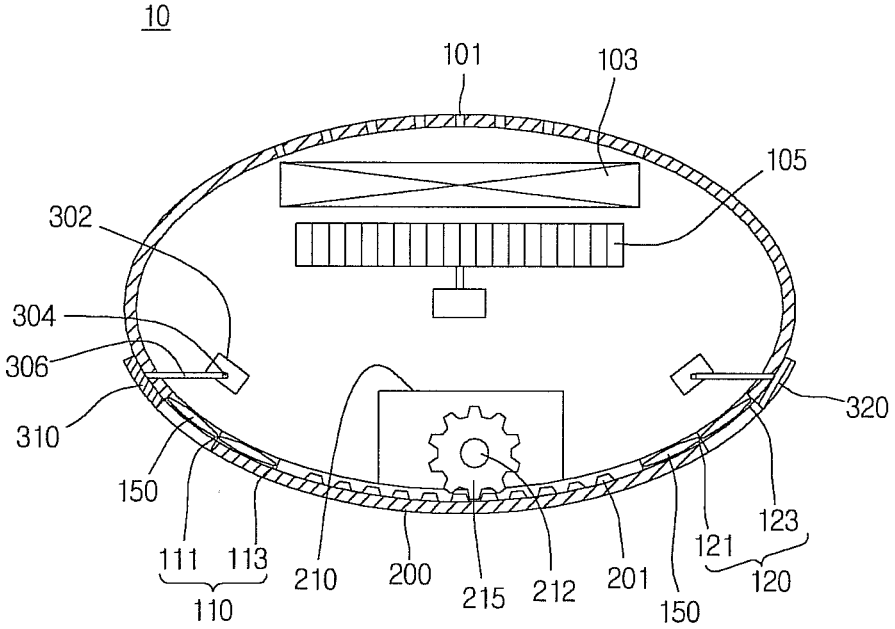
FIG. 6 is a cross-sectional view taken along line II-II' of FIG. 4.

FIG. 5 is a cross-sectional view taken along line I-I' of FIG. 4. FIG. 6 is a cross-sectional view taken along line II'-II' of FIG. 4.

Referring to FIG. 5, the case 100 according to an embodiment includes a suction part 101 through which air is drawn into the case 100 and the plurality of discharge ports 110 and 120 through which air is discharged.

The suction part 101 may be provided at a rear surface of the case 100. A heat exchanger 103 and fans 105 and 106 may face the suction part 101. The fans 105 and 106 may include a first fan 105 and a second fan 106 disposed under the first fan 105.

The first discharge port 110 disposed at a left side of the operation panel 200 and the second discharge port 120 disposed at a right side of the operation panel 200 may be linked to be opened or closed together, or may be independently opened or closed. When the fans 105 and 106 are operated, air is introduced into the case 100 through the suction part 101 to pass through the heat exchanger 103.

Then, the heat exchanged air may be branched to the first and second discharge ports 110 and 120 and discharged.

Referring to FIG. 6, the air conditioner 10 according to an embodiment may include a driving device for moving the discharge panels 310 and 320. The driving device may include a first motor 210 for generating a driving force for moving the operation panel 200, a pinion gear 215 rotated by the first motor 210, and a rack gear 201 linked with the pinion gear 215.

The first motor 210 may be disposed at a rear side of the operation panel 200 and include a motor shaft 212 to which the pinion gear 215 is connected. The rack gear 201 may be disposed on a side of the operation panel 200, particularly, a rear side of the operation panel 200.

The first motor 210 may be a bidirectionally rotatable motor.

When the first motor 210 is rotated in a first direction, the pinion gear 215 may rotate to correspond to the rotation of the first motor 210, and move along the rack gear 201 in a corresponding direction, for example, in a clockwise direction (a left side when viewed from the front surface of FIG. 2). Thus, the operation panel 200 may be moved to cover the first discharge port 110. Here, the first discharge panel 310 may be in the opened state, as shown in FIG. 6.

On the other hand, when the first motor 210 is rotated in a second direction (opposite the first direction), the pinion gear 215 may rotate to correspond to the rotation of the first motor 210 and move along the rack gear 201 in an opposite direction, for example, in a counterclockwise direction (a right side when viewed from the front surface of FIG. 2). Thus, the operation panel 200 may cover the second discharge section 120. Here, the second discharge panel 320 may be in the opened state, as shown in FIG. 6.

The driving device may include a second motor 302 for generating a driving force for moving the discharge panels 310 and 320 and a power transmission member 306 rotated according to an operation of the second motor 302. The power transmission member 306 may be connected to a motor shaft 304 of the second motor 302 and rotated in a clockwise or counterclockwise direction. The power transmission member 306 may be, for example, a link member. The power transmission member 306 may be coupled to one surface of each of the discharge panels 310 and 320, particularly, a rear surface of each of the discharge panels 310 and 320.

Two second motors 302 and power transmission members 306 may be disposed on two inner side portions of the case 100 to move the first and second discharge panels 310 and 320, respectively. The second motor 302 may be a bidirectionally rotatable motor.

In the operation of the first discharge panel 310, when the second motor 302 and the motor shaft 304 are rotated in one direction, the power transmission member 306 is rotated in the clockwise direction. Thus, the first discharge panel 310 is operated to open the first discharge port 110. On the other hand, in a state where the first discharge panel 310 is opened, when the second motor 302 and the motor shaft 304 are rotated in the other direction, the power transmission member 306 is rotated in the counterclockwise direction. Thus, the first discharge panel 310 is operated to close at least a portion of the first discharge port 110.

In the operation of the second discharge panel 320, when the power transmission member 306 is rotated in the counterclockwise direction, the second discharge panel 320 is operated to open the second discharge port 120 (a dotted line in FIG. 6). On the other hand, in the state in which the second discharge panel 320 is opened, when the power transmission member 306 is rotated in the clockwise direction, the second discharge panel 320 is operated to close at least a portion of the second discharge part 120.

The first discharge port 110 includes a first discharge area 111 and a second discharge area 113 which may be selectively covered. The first and second discharge areas 111 and 113 may define separate portions of the first discharge port 110. One discharge vane 150 may be disposed in front of each of the first and second discharge areas 111 and 113. Thus, each of the first and second discharge areas 111 and 113 may be considered an area which may be opened or closed by the discharge vane 150, i.e., an area corresponding to the discharge vane 150. Similarly, the second discharge port 120 may include a third discharge area 121 and a fourth discharge area 123. One discharge vane 150 may be disposed in front of each of the third and fourth discharge areas 121 and 123. The second discharge area 113 and the third discharge area 121 may be disposed between the first discharge area 111 and the fourth discharge area 123.

As shown in FIGS. 1 and 2, in a state in which both of the first and second discharge ports 110 and 120 are closed, the first area 111 is covered by the first discharge panel 310, and the second area 113 is covered by the operation panel 200. Also, the third discharge area 121 is covered by the operation panel 200, and the fourth discharge area 123 is covered by the second discharge panel 320.

Here, the second and third discharge areas 113 and 121 may be spaced apart from each other. Also, the second and third discharge areas 113 and 121 may be simultaneously covered by the operation panel 200 depending on a position of the operation panel 200. The second and third discharge areas 113 and 121 may be considered central areas of the first and second discharge parts 110 and 120, respectively.

In this state, when the first discharge panel 310 is opened, a portion of the first discharge port 110, the first discharge area 111, is exposed to the outside. Also, when the second discharge panel 320 is opened, a portion of the second discharge port 120, i.e., the fourth discharge area 123, is exposed to the outside (see FIG. 4). When the discharge vane 150 corresponding to the first discharge area 111 and the discharge vane 150 corresponding to the fourth discharge area 123 are opened, air is discharged through the corresponding discharge areas 111 and 123.

The operation panel 200 is disposed at a front central position of the case 100, i.e., the first position to cover the second and third discharge areas 113 and 121. Thus, the discharge of air through the second and third discharge areas 113 and 121 may be restricted, and air may be discharged through the first and fourth discharge areas 111 and 123.

As a result, air may be discharged through the opened discharge areas of both sides of the operation panel 200 in both side directions (see FIG. 4). That is to say, the opened areas of the discharge ports 110 and 120 may be disposed on two opposite sides of the operation panel 200.

In summary, in this arrangement, since the particular areas through which the air is actually discharged among all of the discharge areas 111, 113, 121, and 123 are restricted to the areas 111 and 123, an active air discharge area may be less than the total areas of all of the discharge ports 110 and 120.

Figure 7:
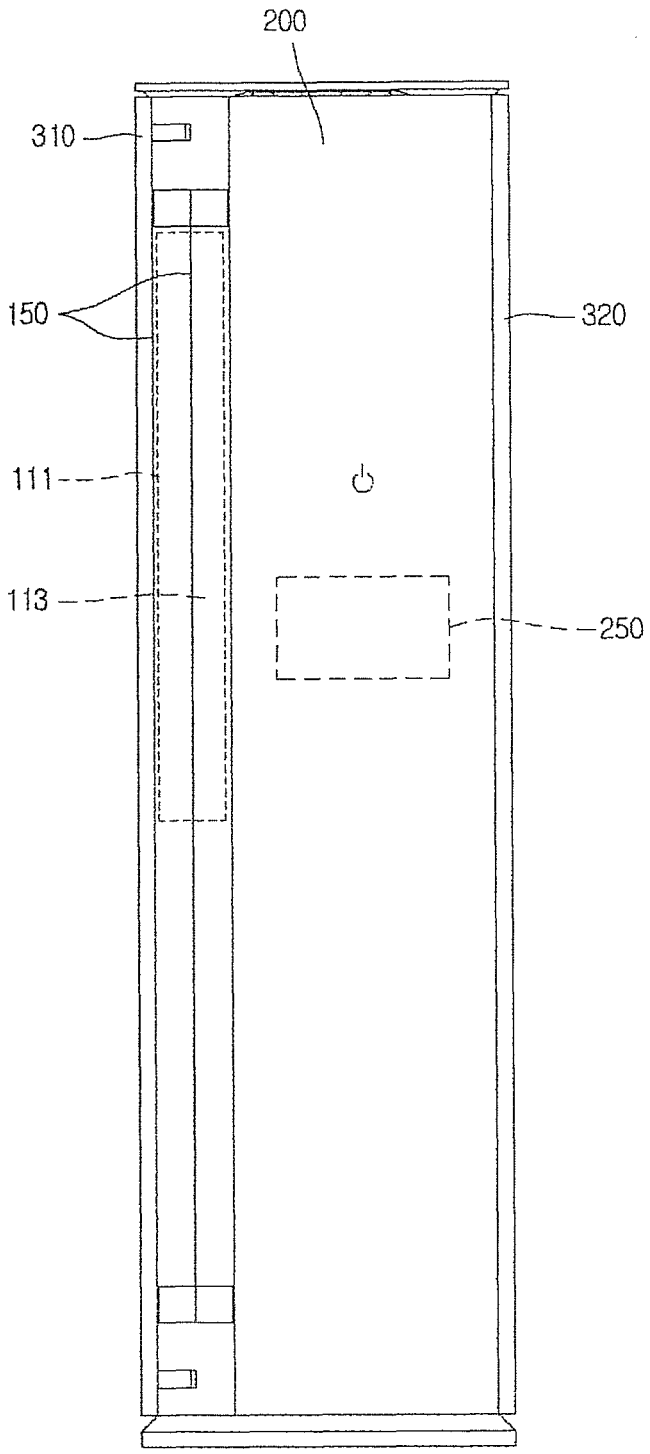
FIG. 7 is a front view of the air conditioner shown in FIG. 1, in a state in which an operation panel thereof is moved in a first direction, according to an embodiment.
Figure 8:
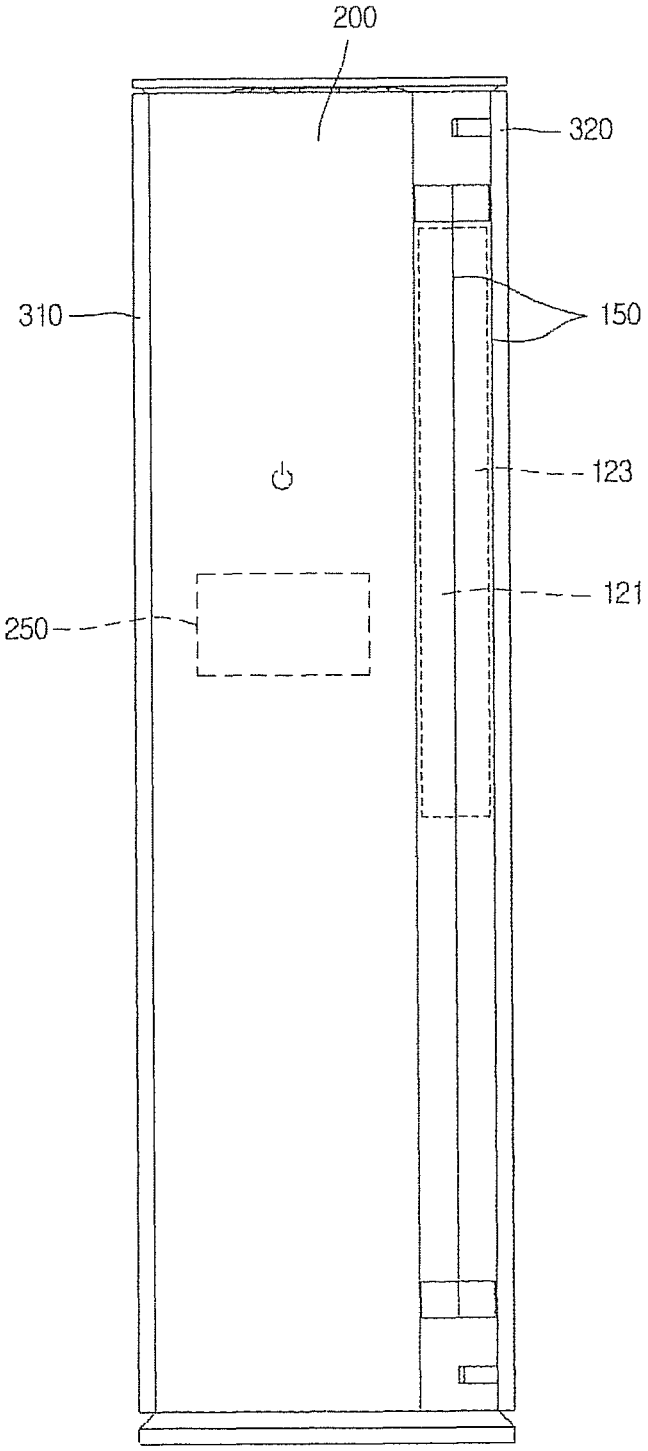
FIG. 8 is a front view of the air conditioner shown in FIG. 1, in a state in which the operation panel thereof is moved in a second direction, according to an embodiment.

FIG. 7 is a view of the air conditioner in a state in which the operation panel is moved in a first direction according to an embodiment, and FIG. 8 is a view of the air conditioner in a state in which the operation panel is moved in a second (opposite) direction according to an embodiment.

Referring to FIG. 7, from the first (central) position shown in FIG. 4, the operation panel 200 may be moved toward the second discharge port 120, i.e., in a right direction. Here, a position of the operation panel 200 may be referred to as a "right position" or a "second position".

When the operation panel 200 is moved to this right, or second position, the second discharge area 113 (of the first discharge port 110) is opened. Thus, air may be concentrated and discharged in a left direction, or from the left portion, of the air conditioner 10.

In detail, when moving the operation panel 200 to the right (second) position the second discharge area 113 may be exposed and the discharge vane 150 corresponding to the second discharge area 113 may be operated to discharge air from the second discharge area 113. As a result, air may be discharged through the first and second discharge areas 111 and 113, i.e., the entire area of the first discharge port 110. In summary, the opened area of the first discharge port 110 may be increased according to the movement of the operation panel 200, and thus the amount of air discharged through the first discharge port 110 may be increased.

As the operation panel 200 is moved to the right, or second position, the fourth discharge area 123 is covered by the operation panel 200. That is to say, the second discharge panel 320 may be moved to open at least one portion of the second discharge port 120, i.e., the fourth discharge area 123. Also, the fourth discharge area 123 may be covered by the operation panel 200. As a result, the third and fourth discharge areas 121 and 123, i.e., the entire area of the second discharge port 120 may be closed by the operation panel 200, and thus the discharge of air through the second discharge area 120 may be restricted.

In summary, the opened area of the second discharge port 120 may be increased or decreased according to the movement of the operation panel 200, and thus the amount of air discharged through the second discharge port 120 may be increased or decreased accordingly. Thus, air may be discharged in a concentrated direction outward from a particular side of the operation panel 200.

As described above, since air may be concentratedly discharged outward from a side of the air conditioner 10 according to a position of the operation panel 200, personalized operation of the air conditioner 10 may be achieved.

However, the overall opened area through which air is discharged, of the first and second discharge ports 110 and 120, may be constant regardless of the proportion between the first and second discharge ports 110 and 120 and position of the operation panel 200. That is, while any two discharge areas are closed, the other two discharge areas are opened.

When the operation panel 200 is disposed at the second position, an actual air discharge area may be restricted to areas 111 and 113. Thus, the air discharge area of the first and second discharge ports 110 and 120 may be less than the whole area of the first and second discharge ports 110 and 120.

Referring to FIG. 8, from the first position shown in FIG. 4, the operation panel 200 may be moved toward the first discharge 110, i.e., in a left direction. Here, a position of the operation panel 200 may be referred to as a "left position" or a "third position".

As described above, when the operation panel 200 is moved to the third position, the third discharge area 121 is opened. Thus, air may be concentrated and discharged in a right direction of the air conditioner 10. In detail, the third discharge area 121 may be exposed to the outside, and the discharge vane 150 corresponding to the third discharge area 121 may be operated to discharge air from the third discharge area 121. As a result, air may be discharged through the third and fourth discharge areas 121 and 123, i.e., the entire area of the second discharge port 120.

In summary, the opened area of the second discharge port 120 may be increased (or decreased) according to the movement of the operation panel 200, and thus the amount of air discharged through the second discharge port 120 is increased (or decreased).

As the operation panel 200 is moved to the third position, the first discharge area 111 is covered by the operation panel 200. As a result, the first and second discharge areas 111 and 113, i.e., the whole of the first discharge port 110 may be closed by the operation panel 200, and thus, the discharge of air through the first discharge port 110 may be restricted.

As described above, the opened area of the first discharge port 110 may be increased (or decreased) according to the movement of the operation panel 200, and thus the amount of air discharged through the first discharge port 110 may be increased (or decreased). Thus, air may be concentratedly discharged outward from a right side of the operation panel 200.

Also, air may be discharged in a concentrated manner outward from the other side of the air conditioner 10 according to the position of the operation panel 200, and thus personalized operation of the air conditioner 10 may be achieved.

However, the total opened area through which air is discharged may be constant, regardless of the position of the operation panel 200. For example, when the operation panel 200 is disposed at the third position, an actual air discharge area may be restricted to areas 121 and 123. Thus, the air discharge area of the first and second discharge ports 110 and 120 may be less than the whole area of the first and second discharge ports 110 and 120.

In the current embodiment, although the operation panel 200 is moved from the first position to the second position, or from the first position to the third position, embodiments are not limited thereto. For example, the operation panel 200 may be moved from the second position to the first position or from the third position to the first position. Also, the operation panel 200 may be moved from the second position to the third position or from the third position to the second position.

Figure 9:
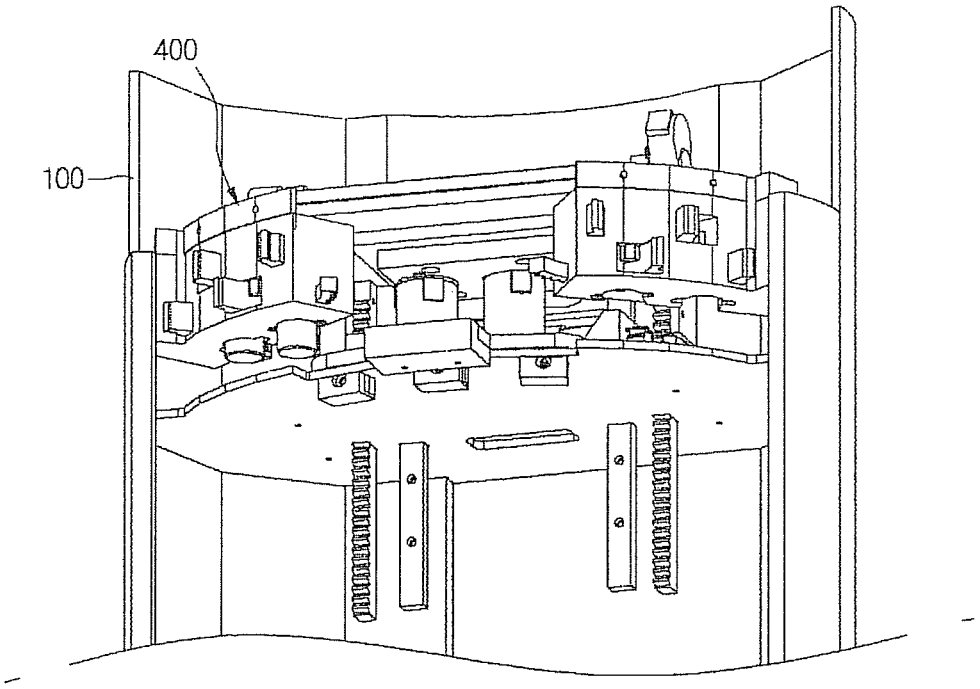
FIG. 9 is an internal perspective view illustrating a discharge vane and vane driver, according to an embodiment.
Figure 10:
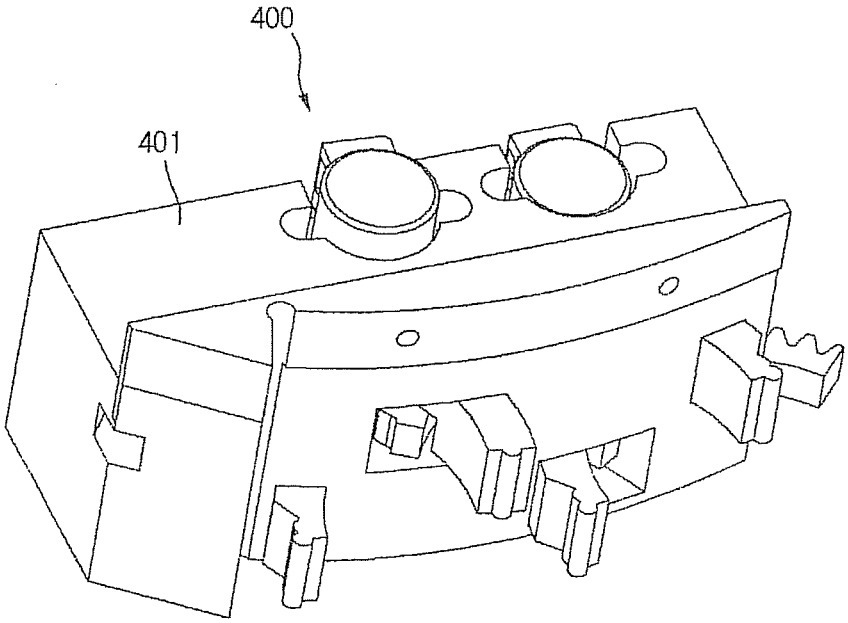
FIG. 10 is a perspective view of an external appearance of the vane driver shown in FIG. 9.

FIG. 9 is an internal perspective view of a mounting of a vane driver for operating the discharge vane, and FIG. 10 is an external perspective view of the vane driver.

Referring to FIGS. 9 and 10, a vane driver 400 according to the current embodiment may be mounted within the case 100. In detail, one or more vane drivers 400 may be mounted on the inner sides of the case 100, positioned corresponding to the discharge vanes 150. In the current embodiment, a pair of discharge vanes 150 may be connected to each vane driver 400. An outer appearance of the vane driver 400 may be defined by a housing 401 having a driving mechanism therein. Hereinafter, a driving mechanism of the discharge vane will be described in detail with reference to the accompanying drawings.

Figure 11:
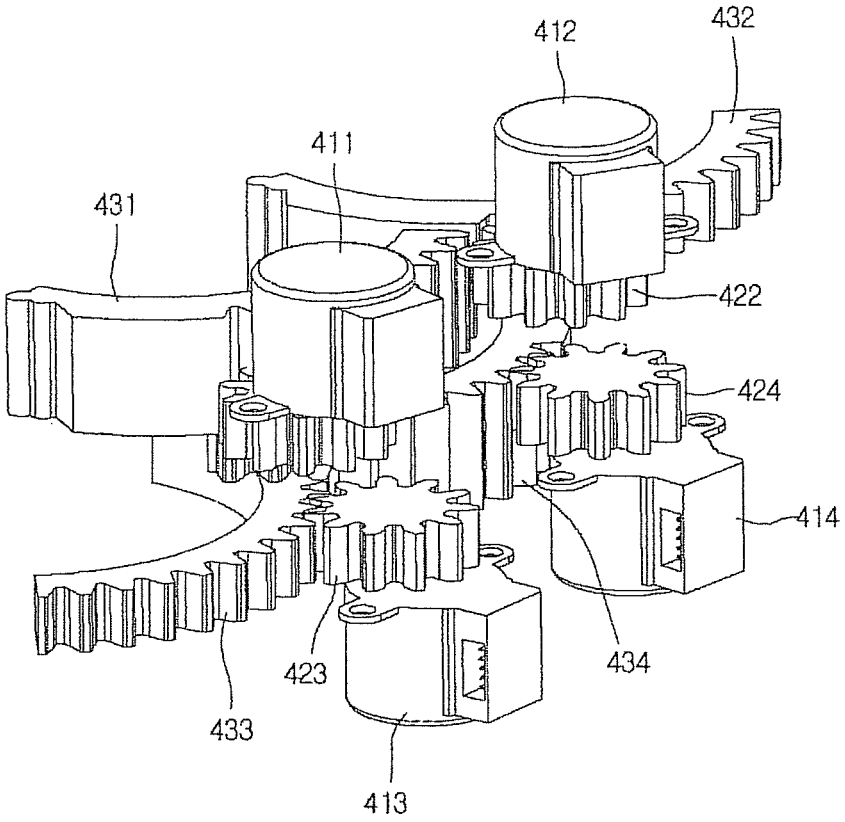
FIG. 11 is a perspective view of the vane driver shown in FIG. 9, with a housing removed.
Figure 12:
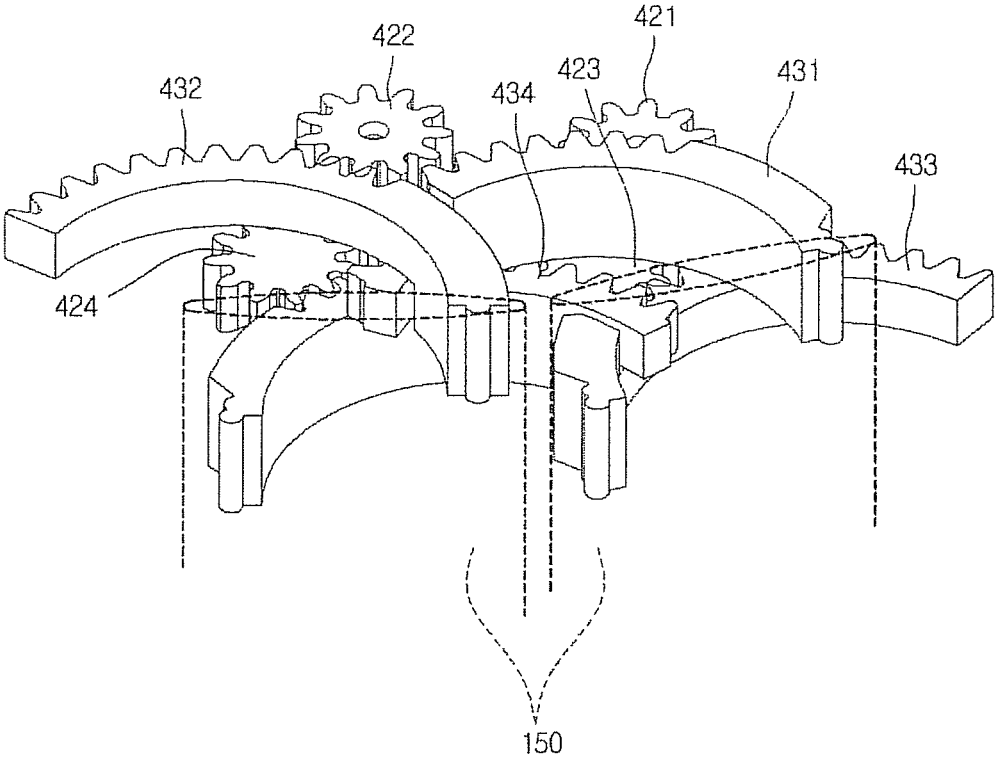
FIG. 12 is a perspective view of the vane driver shown in FIG. 9, with a driving motor removed.

FIG. 11 is a perspective view of the vane driver 400 with the housing 401 removed, and FIG. 12 is a perspective view with a driving motor removed.

Referring to FIGS. 11 and 12, the vane driver 400 according to the current embodiment may include a rotation rack, a pinion engaged with the rotation rack, and a driving motor for providing a rotation force to the pinion. In detail, two discharge vanes 150 may be connected to one vane driver 400. Also, a pair of pinions respectively engaged with a pair of rotation racks may be connected to one side or both sides of upper and lower ends of the discharge vane 150, and a driving motor may be connected to each of the pair of pinions.

A separate vane driver 400 may be provided to each of the first and second discharge ports 110 and 120, with two discharge vanes 150 provided to each of the first and second discharge ports 110 and 120. The two discharge vanes 150 may be disposed in parallel to each other and arranged vertically, side by side. Hereinafter, a driving mechanism for driving the pair of discharge vanes 150 provided to one of the first or second discharge ports 110 and 120 will be described as an example.

Particularly, the two discharge vanes 150 provided to one of the discharge ports 110 and 120 may be connected to right rotation racks 431 and 432 and left rotation racks 433 and 434, respectively, with pinions 421 to 424 and driving motors 411 to 414 respectively connected to the rotation racks 431 to 434. The right rotation racks 431 and 432 may be connected to an upper or lower side of the left rotation racks 433 and 434 to prevent the racks 431 to 434 from interfering with each other. As shown in the drawings, each of the rotation racks 431-434 may have a curved shape with a predetermined curvature. Gear teeth to which the pinions 421-424 are coupled are disposed on an outer surface of the respective rotation rack 431-434. Here, the left rotation racks 433 and 434 may be connected to a left edge of the discharge vane 150 to rotate the left edge of the discharge vane 150, and the right rotation racks 431 and 432 may be connected to a right edge of the discharge vane 150 to rotate the right edge of the discharge vane 150.

Figure 13:
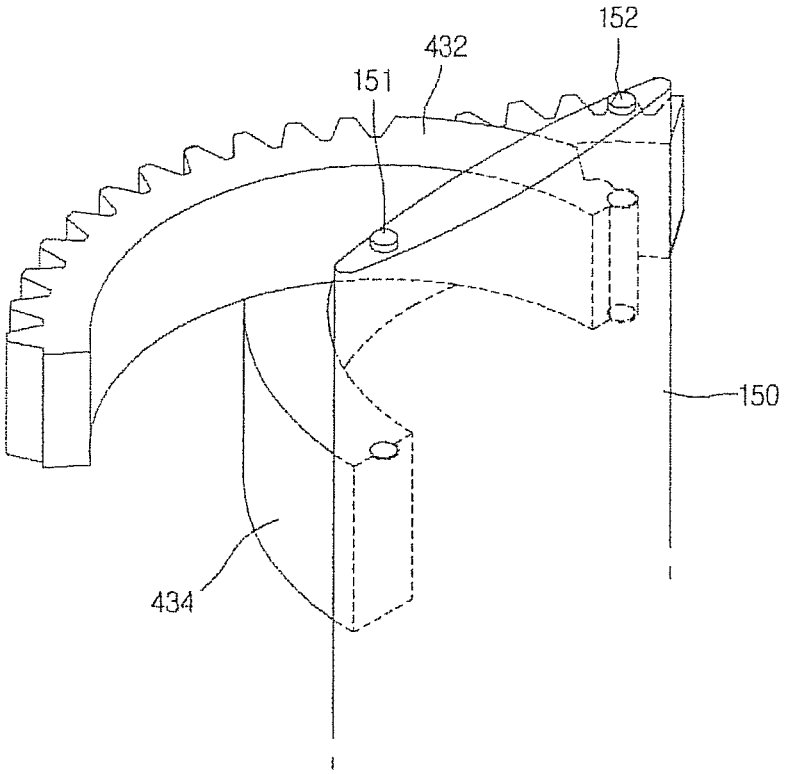
FIG. 13 is a partial perspective view of a rotation rack connected to one discharge vane.

FIG. 13 is a partial perspective view illustrating one discharge vane connected to a rotation rack.

Referring to FIG. 13, the rotation racks 432 and 434 may be connected to an edge of a rear surface of the discharge vane 150. Also, the rotation racks 432 and 434 may be connected to one or both of the upper and lower ends of the discharge vane 150. In detail, the right rotation rack 432 may have one end rotatably connected to a right edge of the back surface of the discharge vane 150 by a hinge shaft. Also, the left rotation rack 434 may be rotatably connected to a left edge of the back surface of the discharge vane 434 by a hinge shaft. The right rotation rack 432 and the left rotation rack 434 may be spaced apart from the other one to prevent interference. In the current embodiment, a structure in which the right rotation rack 432 is disposed above the left rotation rack 434 will be described as an example.

Here, for convenience of description, the hinge shaft provided at the left edge of the discharge vane 150 may be referred to as a first hinge shaft 151, and the hinge shaft provided at the right edge may be referred to as a second hinge shaft 152. Also, the left rotation rack connected to the first hinge shaft 151 may be referred to as a first rotation rack, and the right rotation rack connected to the second hinge shaft 152 may be referred to as a second rotation rack.

Many rotatable discharge vanes employ a single shaft structure disposed along a central longitudinal axis of a discharge vane. In a discharge vane having a structure in which a rotation shaft is disposed on only one of a left or right edge (or a leading or trailing edge) thereof, the discharge vane may only function to open or close a discharge hole. In addition, in a discharge vane in which a rotation shaft is disposed at a center thereof, an air conditioner may have relatively low efficiency in a biased air flow mode.

That is, when cool air is discharged in a state in which the discharge vane is rotated in a left or right direction with respect to a front side of the air conditioner, the cool air discharged through a gap defined between an edge of the discharge hole and the right or left end of the discharge vane is not discharged in a set direction, and thus a large amount of cool air is discharged in a front direction. However, according to the current embodiment, when the discharge vane may rotate about both its edges, a biased flow effect may be significantly improved. That is to say, since the rotation center is defined at the left or right edge of the discharge vane in a biased flow mode, a gap defined between the edge of the discharge hole and the side ends of the discharge vane is relatively small. In a case where the discharge vane in which the rotation shaft is disposed at a center thereof and the discharge vane according to the current embodiment are rotated at the same angle, when comparing a gap between the edge of the discharge vane and the edge of the discharge hole, the structure of the discharge vane according to the current embodiment has a smaller gap. This means that most discharged air is discharged in the direction set by the discharge vane.

Figure 14A:
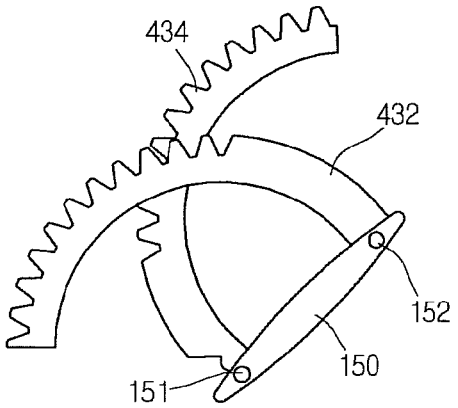
FIGS. 14A-14C operation of the discharge vane, according to an embodiment as broadly described herein.
Figure 14B:
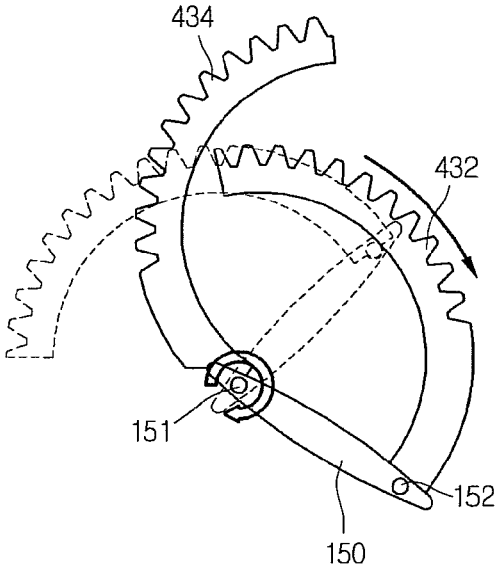
Figure 14C:
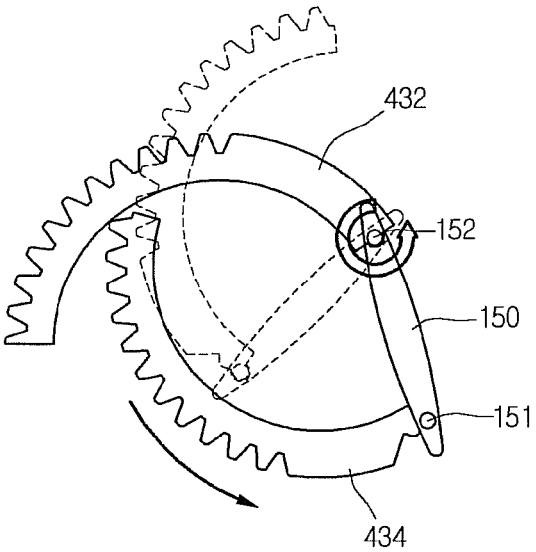

FIGS. 14A-14C illustrate operation of the discharge vane according to an embodiment, as broadly described herein.

In particular, in FIG. 14A the discharge vane 150 is in a state in which the indoor unit is not operated. In FIG. 14B the discharge vane 150 is rotated in a right-biased air flow mode. In the right-biased mode, the discharge vane 150 is rotated with respect to a left rotation center thereof, i.e., the first hinge shaft 151. For this, the right rotation rack 432 is moved in a front direction. Since the right rotation rack 432 has a curved shape with a predetermined curvature, the pinion 422 engaged with the right rotation rack 432 is rotated by the driving motor 412, the right rotation rack 432 is rotated along an arc of the first hinge shaft 151. As a result, the discharge vane 150 is rotated at a predetermined angle with respect to a center of the first hinge shaft 151. Also, the rotation angle of the discharge vane 150 may be determined by a length of the rotation rack 432.

FIG. 14C illustrates a state in which the discharge vane 150 is rotated in a left-biased air flow mode. Contrary to the right-biased air flow mode, in the left-biased mode, the left rotation rack 434 is moved to rotate the discharge vane 150 with respect to the second hinge 152.

FIGS. 15 to 17 and 18A-18B illustrate operation of the discharge panels and an upper discharge device in each of operation modes.

Figure 15:
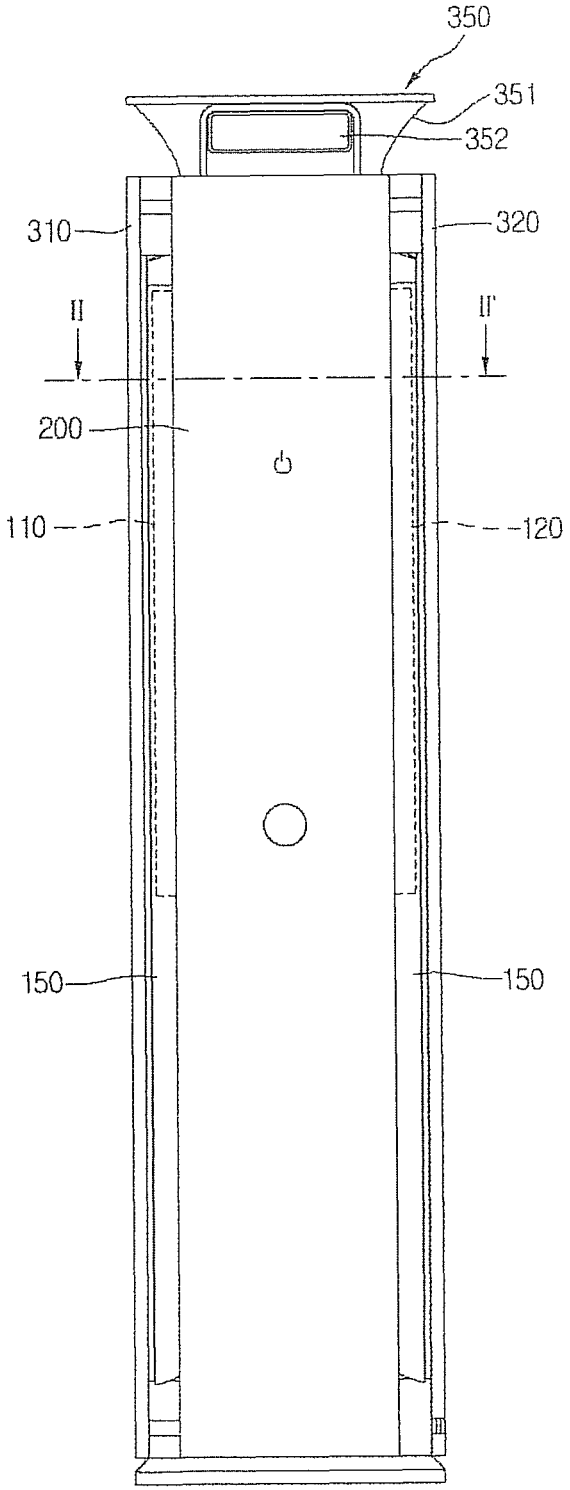
FIGS. 15 to 17 and 18A-18B are perspective views of operation of the discharge panel and an upper discharge device in various operation modes.

Referring to FIG. 15, the air conditioner 10 according to an embodiment may further include an upper discharge device 350 mounted on a top surface of the case 100. The upper discharge device 350 may be moved upward or downward and may include a housing 351 defining an external appearance thereof, with an upper discharge port 352 provided at a front surface of the housing 351.

When the upper discharge device 350 is not used, the upper discharge device 350 may be retracted into the case 100. On the other hand, when the upper discharge device 350 is to be used, the upper discharge device 350 may extend outward and upward from the case 100.

The upper discharge device 350 may also include a discharge duct 360 for guiding the discharge of air. The discharge duct 360 may be elevated and horizontally rotated together with the housing 351. Alternatively, the discharge duct 360 may be vertically and independently rotated with respect to the housing 351. A front end of the discharge duct 360, i.e., a discharge end, may be exposed to the outside through the upper discharge port 352 of the housing 351.

Referring to FIG. 15, when the operation of the air conditioner 10 is initiated, the discharge ports 110 and 120 disposed at left and right sides of the case 100 may be opened according to an operation mode, and the upper discharge device 350 may be elevated upward according to the operation mode to open the upper discharge section 352.

As shown in FIG. 15, the first discharge panel 310 may slide toward outside of the case 100. Then, in a state where the operation panel 200 is disposed at a center of the case 100, only the first and second left and right discharge areas 111 and 123 are opened.

Figure 16:
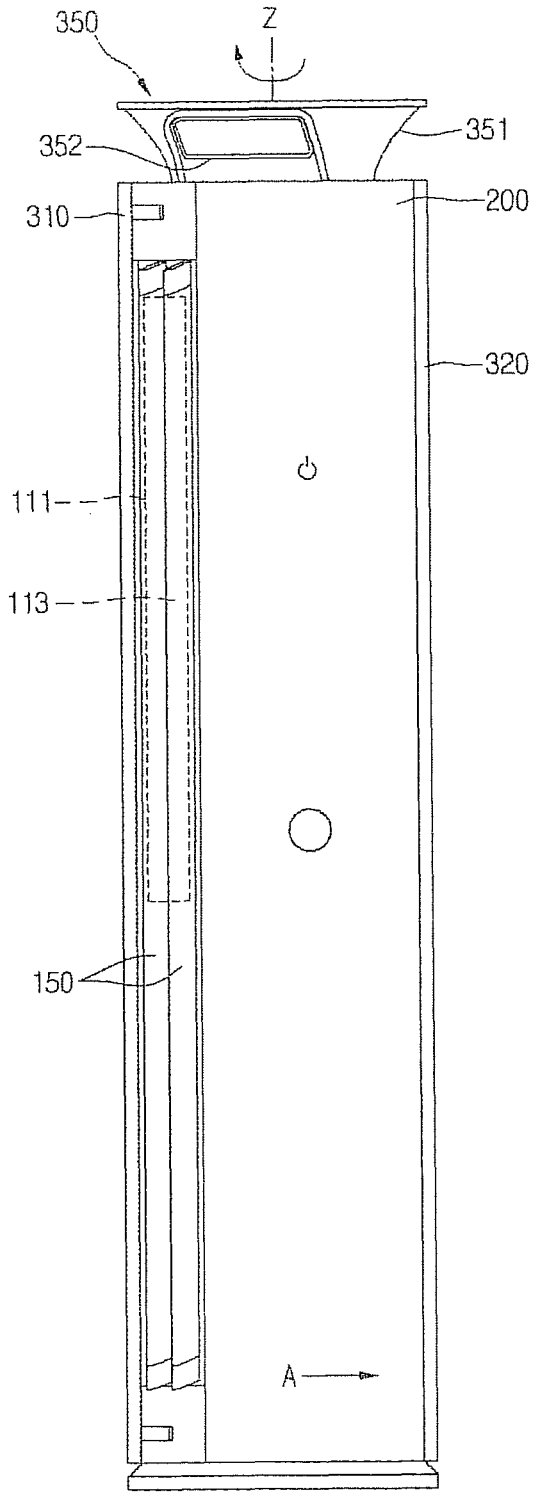

Referring to FIG. 16, the operation panel 200 is moved in a right direction from the position shown in FIG. 15. Also, the left discharge area is expanded up to the first and second discharge areas 111 and 113, and thus, the right discharge area is covered. Also, the discharge vane 150 disposed at the left discharge area may be rotated in left and right directions to generate left-biased air flow. Here, the upper discharge device 350 may be rotated in a left direction to also discharge air through only a left side of the air conditioner 10.

Figure 17:
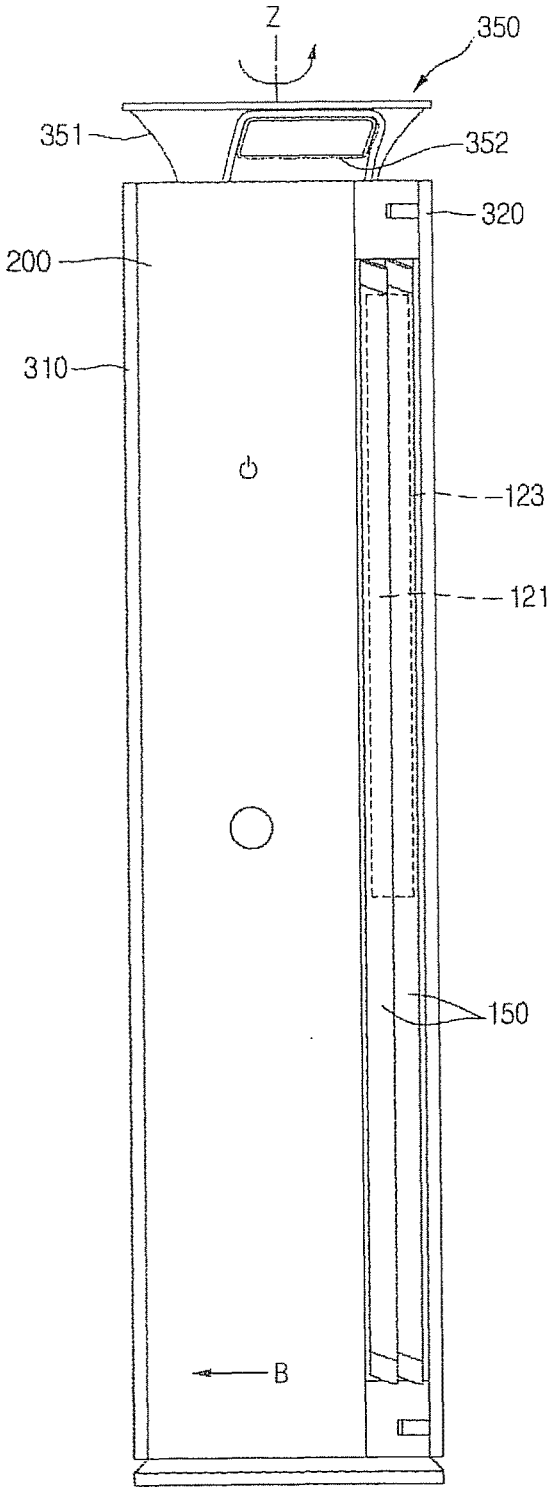

Referring to FIG. 17, the operation panel 200 is moved in a left direction from the center of the case 100, and the right discharge area is expanded up to the third and fourth areas 121 and 123, and thus, the left discharge area is covered. The discharge vane 150 disposed on the right discharge area may be rotated in the left and right directions to generate right-biased air flow. Here, the upper discharge device 350 may be rotated in a right direction to discharge air through only a right side of the air conditioner 10.

Figure 18A:
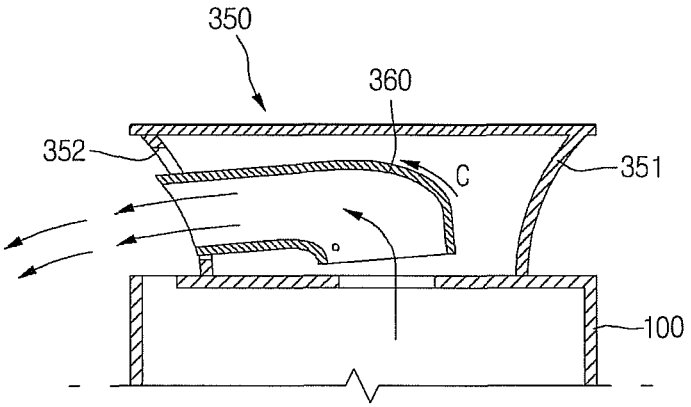
Figure 18B:
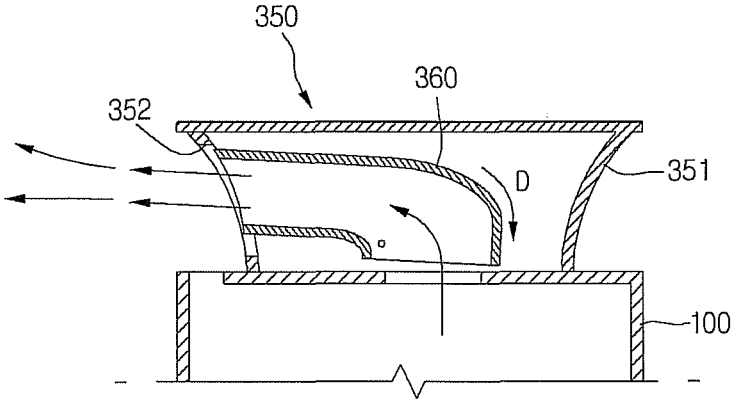

As shown in FIG. 18A, a front end of the discharge duct 360 may be rotated in a direction C so that the front end of the duct 360 faces downward, toward a lower side. As shown in FIG. 18B, the front end of the discharge duct 360 may be rotated in a direction D so that the front end of the duct 360 faces straight out.

The discharge duct 360 may be rotated in up and down directions according to the operation mode. For example, the front end of the discharge duct 360 may be rotated to face upward in a long power air flow mode, i.e., a mode set for blowing cool air a relatively long distance. The discharge duct 360 may be rotated downward in a mode set for supplying concentrated cool air to a short-distance position.

The operation in which the housing 351 is rotated in left and right directions and the operation in which the discharge duct 360 is rotated in up and down directions may be performed at the same time or independently performed. That is, when the housing 351 is rotated in the left or right direction, the discharge duct 360 may be rotated in the left or right directions together with the housing 351. Also, in the state where the discharge duct 360 is moved in the left or right direction, the discharge duct 360 may be continuously rotated in the up or down direction.

Hereinafter, the moving state of the cool air discharge mechanism including the operation panel 200, the discharge panel 310, and the discharge vane 150 according to the operation mode will be described in detail with reference to the accompanying drawings.

Figure 19:
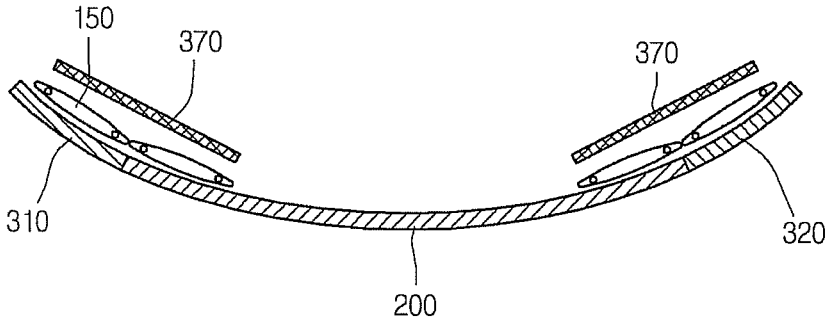
FIG. 19 is a cross-sectional view of a cool air discharge mechanism in an operation stop state.

FIG. 19 is a cross-sectional view of the cool air discharge mechanism in an operation stop state. In the operation stop state, the discharge sections 110 and 120 are fully closed by the operation panel 200 and the discharge panels 310 and 320. The discharge vane 150 is disposed on a front side of the discharge grill 370 and covered by portions of the discharge panels 310 and 320 and the operation panel 200.

Figure 20:
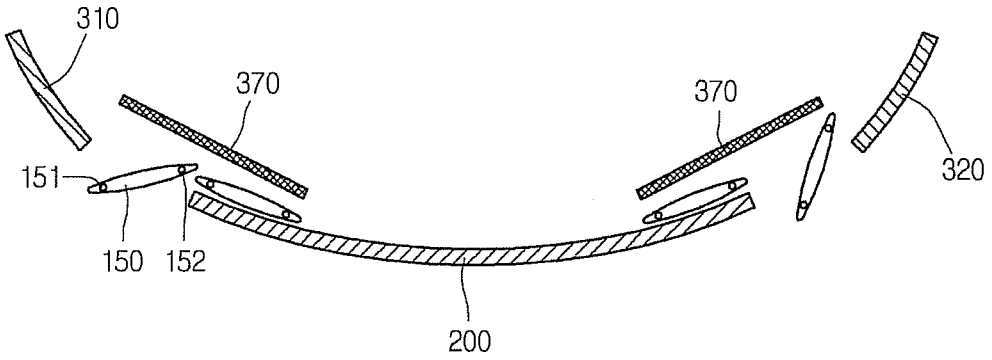
FIGS. 20 and 21 are cross-sectional views of the cool air discharge mechanism in a normal mode.
Figure 21:
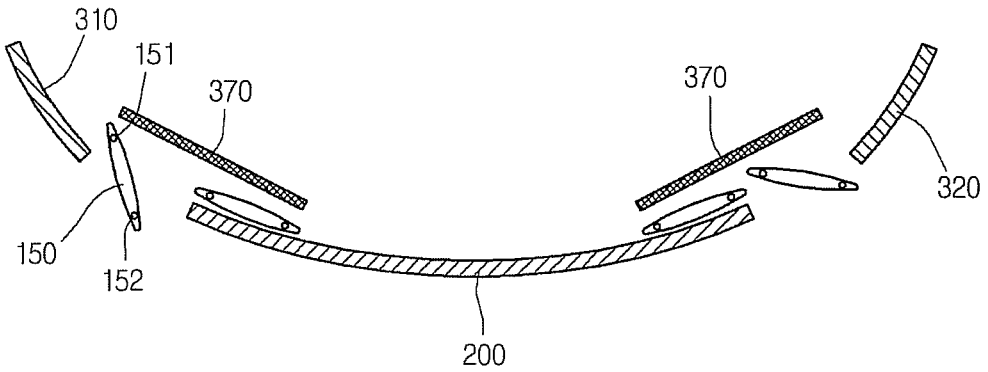

FIGS. 20 and 21 are cross-sectional views of the cool air discharge mechanism in a normal mode. In the normal mode, the operation panel 200 is disposed at a front center of the air conditioner 10, and both discharge panels 310 and 320 are slid toward the outside of the case 100, away from the operation panel 200 to open the first and fourth discharge areas 111 and 121 of the first and second discharge ports 110 and 120.

In this state, the discharge vanes 150 disposed on the first and second areas 111 and 121 are respectively rotated with respect to the first and second hinge shafts 151 and 152 to discharge the cool air in a wave form.

Due to the vane including the two hinge shafts according to the current embodiment, i.e., a dual hinge vane structure, while the discharge vane 150 is rotated in the left and right directions, the discharge vane 150 protrudes toward a front side of the discharge port. Thus, a flow resistance of cool air flowing toward the front side within the case 100 may be reduced.

That is, when compared to a case of a cool air discharge mechanism including a hinge shaft disposed on a center of a discharge vane, one of the left end or right end of the hinge shaft would protrude toward a front side of the case, with the other end inserted into the case. As a result, before cool air is discharged to the outside, flow resistance may occur due to the discharge vane, causing a portion of the cool air not to be discharged to the outside and an eddy-current phenomenon within the air conditioner.

In contrast, in the dual hinge vane structure according to an embodiment as broadly described herein, the discharge vane extending up to an opposite end with respect to the hinge shaft serving as a rotation center protrudes toward the front side of the case 100. Thus, only a portion of an end of the discharge vane adjacent to the hinge shaft serving as the rotation center is disposed within the case 100. Thus, the cool air discharged by the fan is discharged to the outside of the case 100 without being affected by flow resistance due to the discharge vane 150. That is, since flow resistance is minimized, air current stability may be obtained, and cool air loss due to flow resistance may be minimized.

In the operation mode according to an embodiment, the discharge vanes 150 of the first and second discharge ports 110 and 120 may be rotated in the same direction or rotated in directions opposite to each other. That is to say, the discharge vanes 150 may be rotated independently. For example, the discharge vane 150 of the first discharge port 110 and the discharge vane 150 of the second discharge port 120 may rotate with respect to the first and second hinge shafts 151 and 152 at the same time. Alternatively, one of the discharge vanes 150 may rotate with respect to the first hinge shaft 151, and the other may rotate with respect to the second hinge shaft 152.

The upper discharge device 350 may be maintained in the case 100 and may be selectively extended out of the case 100 to supply air flow in a front direction.

FIG. 21 is a cross-sectional view of the cool air discharge mechanism in a mode.

Figure 22:
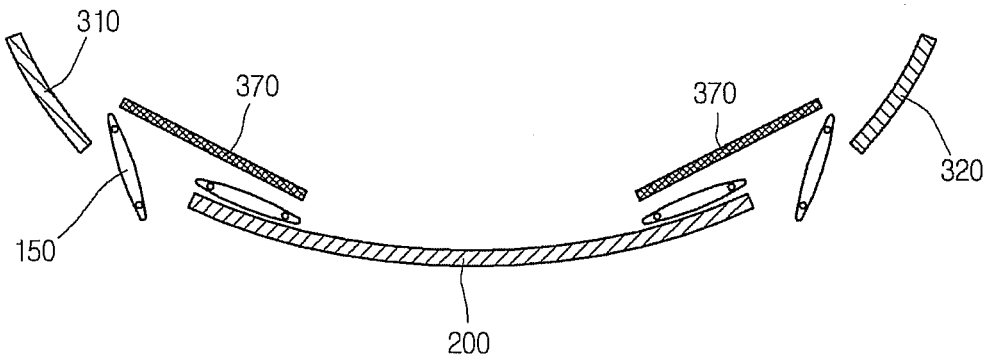
FIG. 22 is a cross-sectional view of the cool air discharge mechanism in a concentrated flow mode.

FIG. 22 is a cross-sectional view of the cool air discharge mechanism in a concentrated flow mode. In the concentrated flow mode, both discharge vanes 150 face a central portion of the air conditioner 10. Thus, discharged air is discharged in a concentrated manner forward from a front surface of the air conditioner 10. Here, the front end of the discharge duct 360 of the upper discharge device 350, i.e., the discharge hole may be rotated downward to maximize the concentrated air flow effect.

Here, the upper discharge device 350 may protrude to the outside, and the discharge end of the discharge duct 360 may be rotated downward to discharge air toward the front side of the air conditioner 10.

Figure 23:
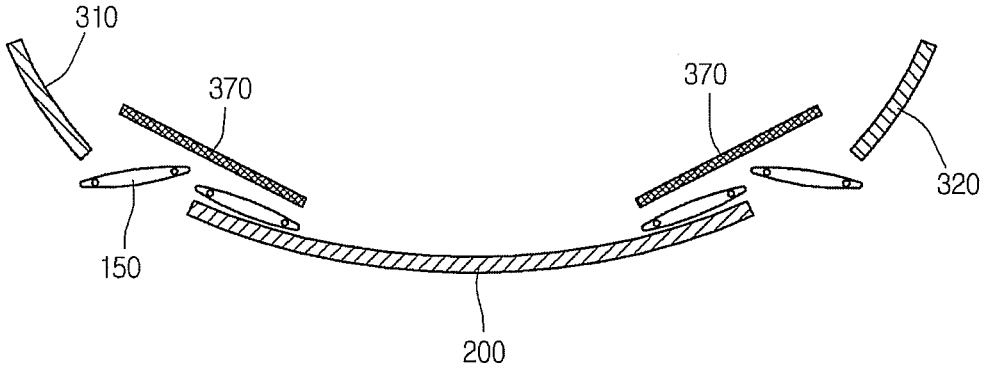
FIG. 23 is a cross-sectional view of the cool air discharge mechanism in an indirect flow mode.

FIG. 23 is a cross-sectional view of the cool air discharge mechanism in an indirect flow mode. In the indirect flow mode, both discharge vanes 150 are fixed to face the outside of the air conditioner 10. Thus, air is discharged outward, in a fan shape, toward left and right sides with respect to the air conditioner 10. Here, the front end of the discharge duct 360 of the upper discharge device 350 may be rotated upward to discharge air outward toward the farthest distance position from the air conditioner 10.

Figure 24:
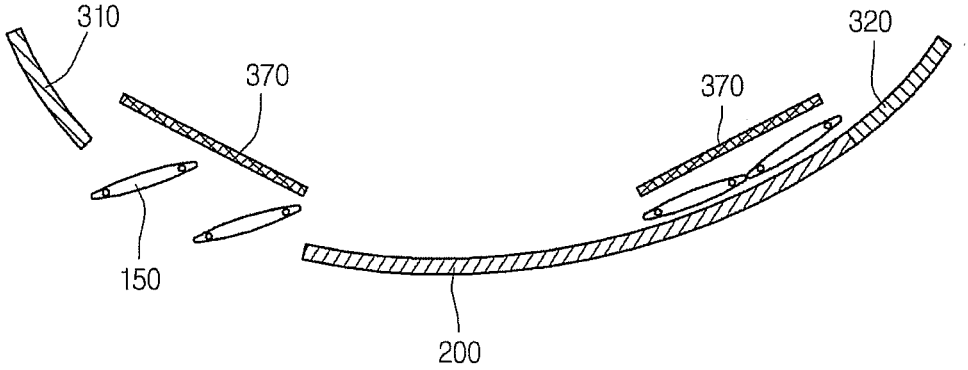
FIG. 24 is a cross-sectional view of the cool air discharge mechanism in a left-biased flow mode.
Figure 25:
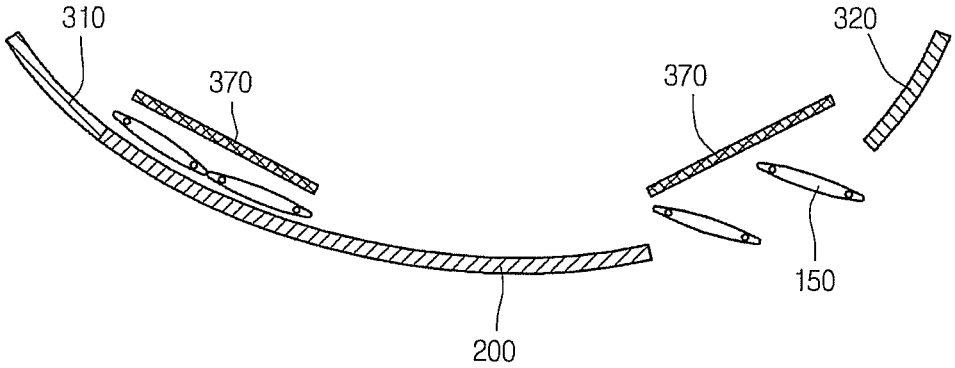
FIG. 25 is a cross-sectional view of the cool air discharge mechanism in a right-biased flow mode.

FIG. 24 is a cross-sectional view of the cool air discharge mechanism in a left-biased air flow mode, and FIG. 25 is a cross-sectional view of the cool air discharge mechanism in a right-biased air flow mode.

Referring to FIG. 24, when the left-biased air flow mode is selected, both discharge panels 310 and 320 slide so that the first and fourth discharge areas 111 and 121 are opened, the operation panel 200 is moved in the right direction. As a result, the right third discharge area 121 is closed by the operation panel 200, and thus, the left second discharge area 112 is opened. Also, since the first and second discharge areas 111 and 112 are opened, the left discharge vanes 150 are exposed to the outside. In this state, the left discharge vanes 150 are alternately rotated with respect to the two hinge shafts 151 and 152. Alternatively, all of the left discharge vanes 150 may be fixed to face the outside of the air conditioner 10. In this state, air may be discharged through only the left side of the air conditioner 10.

The upper discharge device 350 may also be rotated in the left direction to discharge air in the left direction, and the discharge duct 360 may be rotated in the up and down directions to generate air flow having the wave form.

The cool air discharge mechanism in the right-biased air flow mode of FIG. 25 may be operated in reverse of that described above with respect to the left-biased air flow mode. Thus, since their descriptions may be sufficiently understood from the description with reference to FIG. 24, their descriptions will be omitted.

According to embodiments as broadly described herein, the discharge area may be varied according to movement of the operation panel and the discharge panels. Thus, the discharge area may be adequately adjusted according to suit a particular environment.

Particularly, since air may be discharged toward the front side or concentratedly discharged according to the position or preferences of the user, personalized operation of the air conditioner may be provided.

Also, since discharge ports may be provided on each of two opposite sides of the operation panel, and the discharge direction and amount of air may be adjusted while the operation panel slides, discharge of air may be simply adjusted.

Also, after the discharge panel is opened to operate the air conditioner, the discharge method may be controlled by manipulating only the operation panel, and thus convenience of manipulation may be enhanced.

When the air conditioner is not operated, the discharge ports may be covered by the operation panel and the discharge panels to improve external appearance.

Embodiments provide an air conditioner in which at least one of a discharge direction or discharge amount of air may be effectively adjusted.

In one embodiment, an air conditioner as broadly described herein may include a case; a first discharge part disposed on side of the case to discharge air; a second discharge part disposed on the other side of the case to discharge air; at least one discharge vane rotatably disposed on the first and second discharge parts; and an operation panel disposed between the first and second discharge parts, the operation panel being movable to vary a discharge area of each of the first and second discharge parts, wherein the discharge vane disposed on an area which is not covered by the operation panel in the first or second discharge part is rotatable.

In another embodiment, an air conditioner as broadly described herein may include an operation panel; a plurality of discharge parts partitioned by the operation panel; and a discharge vane disposed on the plurality of discharge parts, wherein the operation panel is movable to selectively open or close the whole of a portion of the plurality of discharge parts, and the discharge vane disposed on an area opened by the movement of the operation panel is rotated.

In another embodiment, an air conditioner as broadly described herein may include a case; a first discharge part disposed on one side of the case to discharge air; a second discharge part disposed on the other side of the case to discharge air; and an operation panel movably disposed between the first discharge part and the second discharge part.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case;

a first discharge port provided at a first side of the case;

a second discharge port provided at a second side of the case;

an operation panel positioned between the first and second discharge ports, the operation panel configured to slidably move in a lateral direction along a curved trajectory to selectively vary a discharge area of each of the first and second discharge ports;

at least one discharge vane provided at each of the first and second discharge ports and selectively rotatable in a discharge area of the respective discharge port;

a first discharge panel coupled to the case and located in front of the at least one discharge vane to selectively shield a portion of the first discharge port and the at least one discharge vane;

a second discharge panel coupled to the case and located in front of the at least one discharge vane to selectively shield a portion of the second discharge port and the at least one discharge vane, wherein the first discharge panel is configured to slidably move along a first portion of the curved trajectory of the operation panel, and the second discharge panel is configured to slidably move along a second portion of the curved trajectory of the operation panel, such that the first and second discharge panels and the operation panel share a single curved trajectory, wherein the operation panel is provided at a central portion of a front surface of the air conditioner, wherein when the operation panel moves in a direction away from the first discharge port, the operation panel covers at least one portion of the second discharge port, wherein when the operation panel moves in a direction away from the second discharge port, the operation panel covers at least one portion of the first discharge port, and wherein the at least one discharge vane disposed in the discharge area of the first or second discharge port which is not covered by the operation panel is rotatable to adjust an air discharge direction therefrom.

2. The air conditioner of claim 1, wherein the operation panel covers remaining portions of the first and second discharge ports not covered by the first and second discharge panels such that the first and second discharge ports are completely covered by the operation panel and the first and second discharge panels when the operation panel is in a central position and the first and second discharge panels are both in a closed position relative to the case.

3. The air conditioner of claim 1, wherein one of the first or second discharge ports is fully opened, and the other is fully closed, when the first and second discharge panels are in an open position relative to the case and the operation panel is positioned so as to cover the other of the first or second discharge port.

4. The air conditioner of claim 1, wherein the at least one discharge vane includes a plurality of discharge vanes provided at each of the first and second discharge ports, and wherein the plurality of discharge vanes are rotated simultaneously in a reciprocal manner in the same direction, or are independently rotated.

5. The air conditioner of claim 1, further including an upper discharge device provided at an upper portion of the case and vertically movable from an upper surface of the case, to be exposed to an outside, wherein the upper discharge device is configured to rotate about both a horizontal axis and a vertical axis to vary a flow direction of air discharged therefrom.

6. The air conditioner of claim 5, wherein the upper discharge device includes:

a housing having an upper discharge port provided on a front surface thereof, the housing being movable in a vertical direction from the upper surface of the case and rotatable about the vertical axis; and a discharge duct received in the housing and integrally moveable with the housing, wherein the discharge duct is in communication with the upper discharge port to discharge air in a forward direction, and wherein the discharge duct is rotatable about the horizontal axis within the housing.

7. The air conditioner of claim 6, wherein, in a normal flow mode, the operation panel is positioned at a center of the case, the first and second discharge panels are each slid away from the operation panel to open positions, the first and second discharge ports are opened so as to form discharge areas corresponding to areas of the first and second discharge panels, and the at least one discharge vane provided in each of the first and second discharge ports is rotated about a vertical axis to vary the flow of air discharged through the first and second discharge ports.

8. The air conditioner of claim 6, wherein, in a concentrated flow mode, the operation panel is positioned at a center of the case, the first and second discharge panels are each slid away from the operation panel to open positions, the first and second discharge ports are opened so as to form discharge areas corresponding to areas of the first and second discharge panels, and the at least one discharge vane provided in each of the first and second discharge ports is rotated about a vertical axis toward a center of the case to concentrate a flow of air discharged from the first and second discharge ports in a central forward external direction.

9. The air conditioner of claim 8, wherein, in the concentrated flow mode, the housing and the discharge duct are lifted upward from the upper surface of the case, and a discharge hole of the discharge duct is rotated downward to direct air discharged therefrom in a central downward external direction.

10. The air conditioner of claim 6, wherein, in an indirect flow mode, the operation panel is positioned at a center of the case, the first and second discharge panels are each slid away from the operation panel to open positions, the first and second discharge ports are opened so as to form discharge areas corresponding to areas of the first and second discharge panels, and the at least one discharge vane provided in each of the first and second discharge ports is rotated away from a central portion of the case to disperse flow discharged from the first and second discharge ports.

11. The air conditioner of claim 10, wherein, in the indirect flow mode, the housing and the discharge duct are lifted upward from the upper surface of the case, and a discharge hole of the discharge duct is rotated upward to disperse air discharged from the discharge duct.

12. The air conditioner of claim 6, wherein, in a biased flow mode, the first and second discharge panels are each slid away from a center of a front surface of the case to open positions, the operation panel is moved in a left direction or a right direction to fully open one of the first discharge port or the second discharge port, and the at least one discharge vane of the opened one of the first or second discharge ports is fixed in a position to guide air flow in a predetermined direction with respect to the case, or is rotated about a vertical axis.

13. The air conditioner according to claim 12, wherein, in the biased flow mode, the housing and the discharge duct are lifted upward from the upper surface of the case, and the housing and the discharge duct are rotated toward the fully opened discharge port.

14. The air conditioner according to claim 1, further including at least one of a display to display information related to operation of the air conditioner or an input device to receive a user's input command, wherein the display and the input device are provided at a front surface of the operation panel.

* * * * *